US007262150B2

(12) United States Patent
Kalishek et al.

(10) Patent No.: US 7,262,150 B2
(45) Date of Patent: Aug. 28, 2007

(54) SECURE THERMALLY IMAGED DOCUMENTS SUSCEPTIBLE TO RAPID INFORMATION DESTRUCTION BY INDUCTION

(75) Inventors: Robert John Kalishek, Appleton, WI (US); Michael Anthony Friese, Appleton, WI (US)

(73) Assignee: Appleton Papers Inc., Appleton, WI (US)

( * ) Notice: Subject to any disclaimer, the term of this patent is extended or adjusted under 35 U.S.C. 154(b) by 258 days.

(21) Appl. No.: 10/872,010

(22) Filed: Jun. 21, 2004

(65) Prior Publication Data

US 2005/0282704 A1 Dec. 22, 2005

(51) Int. Cl.
*B41M 5/40* (2006.01)

(52) U.S. Cl. ..... 503/201; 503/200

(58) Field of Classification Search ..... 503/200–226
See application file for complete search history.

(56) References Cited

U.S. PATENT DOCUMENTS

| | | | | |
|---|---|---|---|---|
| 3,967,034 | A | 6/1976 | Meadus et al. | 428/323 |
| 4,158,648 | A | 6/1979 | Meadus et al. | 260/15 |
| 4,883,936 | A | 11/1989 | Maynard et al. | 219/10.55 |
| 4,962,293 | A | 10/1990 | Lackey | 219/10.55 |
| 4,970,358 | A | 11/1990 | Brandberg et al. | 219/10.55 |
| 4,970,360 | A | 11/1990 | Pesheck et al. | 219/10.55 |
| 5,038,009 | A | 8/1991 | Babbitt | 219/10.55 |
| 5,120,176 | A | 6/1992 | Bhatia et al. | 412/8 |
| 5,132,144 | A | 7/1992 | Parks | 427/210 |
| 5,175,031 | A | 12/1992 | Ochocki | 428/34.2 |
| 5,212,040 | A | 5/1993 | Sanders et al. | 430/126 |
| RE34,683 | E | 8/1994 | Maynard et al. | 219/703 |
| 5,362,504 | A | 11/1994 | Kamper et al. | 426/89 |
| 5,457,080 | A * | 10/1995 | Takano et al. | 503/207 |
| 5,565,125 | A | 10/1996 | Parks | 219/759 |
| 5,571,627 | A | 11/1996 | Perry et al. | 428/458 |
| 5,614,259 | A | 3/1997 | Yang et al. | 427/255.1 |
| 5,814,138 | A | 9/1998 | Fague | 106/31.43 |
| 5,997,623 | A | 12/1999 | Lin | 106/31.58 |
| 6,197,723 | B1 * | 3/2001 | Gotoh | 503/201 |
| 6,425,663 | B1 | 7/2002 | Eastlund et al. | 347/102 |
| 6,427,922 | B1 | 8/2002 | Marchand | 235/494 |
| 6,649,888 | B2 | 11/2003 | Ryan et al. | 219/634 |
| 6,677,274 | B2 | 1/2004 | Geuens et al. | 503/212 |
| 2003/0118825 | A1 | 6/2003 | Melius et al. | |

* cited by examiner

*Primary Examiner*—Bruce H. Hess
(74) *Attorney, Agent, or Firm*—Benjamin Mieliulis

(57) ABSTRACT

A thermally image record material such as a secure document is taught which is susceptible to rapid and bulk destruction of confidential or sensitive information by microwave or high energy absorption. The thermally responsive record material comprises a heat sensitive composition applied onto a substrate having provided thereon in proximity, to the heat sensitive composition as a subcoat or undercoat or back side coating, a layer of particles of an energy receiver material such as a microwave susceptor. Sensitive information imprinted on the record material can be readily destroyed by microwave heating.

2 Claims, 2 Drawing Sheets

SECURE THERMALLY IMAGED DOCUMENTS SUSCEPTIBLE TO RAPID INFORMATION DESTRUCTION BY INDUCTION

BACKGROUND OF THE INVENTION

1. Field of the Invention

This invention relates to thermally-responsive record material. It more particularly relates to such record material in the form of sheets coated with color-forming systems comprising chromogenic material (electron-donating dye precursors) and acidic (electron accepting) color developer material. The invention particularly concerns thermally imaging record materials imaged with sensitive information such as prescriptions, prescription container labels, government forms, tax returns, banking statements, credit card receipts, account information and the like, where privacy or security of the information is desirable.

2. Description of the Related Art

Thermally-responsive record material systems are well known in the art and are described in many patents, for example, U.S. Pat. Nos. 3,539,375; 3,674,535; 3,746,675; 4,151,748; 4,181,771; 4,246,318; 4,470,057 which are incorporated herein by reference. In these systems, basic chromogenic material and acidic color developer material are contained in a coating on a substrate which, when heated to a suitable temperature, melt or soften to permit said materials to react, thereby producing a colored mark.

Thermally-responsive record materials are typically imaged by use of a thermal print head that is moved across the sheet (serial type) or against which the sheet is moved. The thermal printhead can span the width of the sheet (line type). The thermal printhead typically has resistive heating elements. A microprocessor is used to selectively heat the individual heating elements to produce the desired image. Typically the finer the heat elements, the less power is required to produce dots that make up the image. The finer the dots and concentration of dots per unit area, the higher is the resolution.

Thermally-responsive record material systems due to their ease of use, low cost, high resolution, and simple operation have gained acceptance supplanting dot matrix printing in many applications.

With increasing concerns relating to information security, prevention of identity theft, and protection of personal privacy, a variety of techniques have been adopted to preserve the confidentiality of printed information. These techniques include shredding, burning, and other means of information destruction. With passage of ever more stringent privacy obligations such as patients rights bills, and other legislation, such as HIPPA requirements in the U.S., there is an increasing need to control private information to maintain confidentiality, reduce liability exposure, reduce risk of administrative agency imposed fines for non-compliance and prevent careless or inadvertent disclosure of private information.

A need exists in some circumstances for rapid destruction of private or sensitive information in bulk. Techniques such as shredding have the drawback of noise, susceptibility to jamming, or possibility of reassembly of information by a determined party. Techniques relying on burning, convection heating, or heating elements are undesirable in many office environments due to safety concerns associated with hot surfaces, fumes, and cleanliness issues in having to deal with ash.

It is an object of the present invention to teach a novel thermal recording system suitable for office environments which when imaged with personal information can be rapidly obscured in bulk without burning or use of devices characterized by fumes or hot surfaces.

SUMMARY OF THE INVENTION

Figure 1:
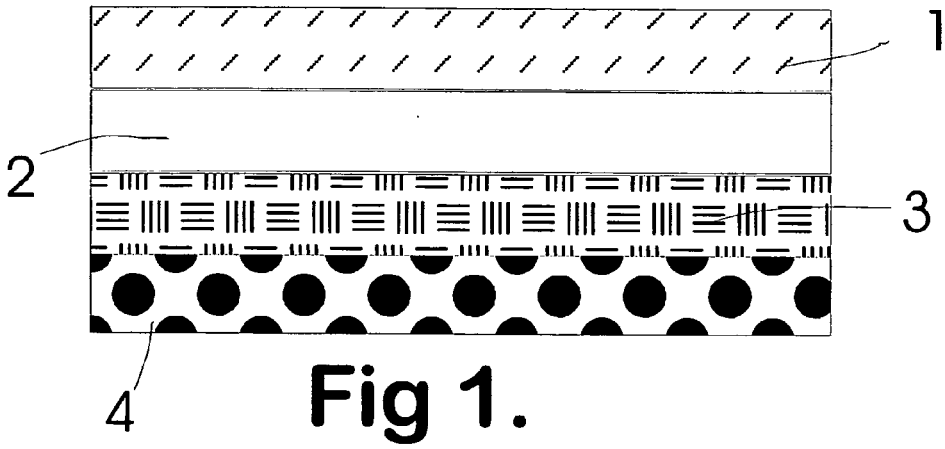
FIG. 1 is a side view cross section of a thermally responsive record material according to the invention that depicts a layer of material susceptible to inductive heating (energy receiver material) as a coating or laminate to the underside of a sheet of paper.

Disclosed is a thermally-responsive record material comprising a substrate having provided thereon a heat sensitive color-forming composition comprising a chromogenic material and an electron accepting developer material. Overcoated over or under the heat sensitive color-forming composition or on the underside of the substrate is at least one layer of a material susceptible to inductive heat including RF or microwave heating (energy receiver material). Inductive heating is used in an expansive sense not limited merely to electromagnetic induction but intended to refer to flameless means of energy transfer to create heat in the energy receiver material. RF or microwave heating are to be understood as encompassed by the term inductive heating as used herein.

In yet another embodiment the invention is a system for obscuring confidential information imaged on a thermal record material and comprises a substrate having first surface and second surfaces and having provided on the first surface one or more layers of a heat sensitive composition comprising a chromogenic material and an electron accepting developer material, and, at least one layer of an energy receiver material in proximity to the heat sensitive composition. The heat sensitive composition on the first surface is applied to all or a portion of the first surface and the energy receiver material is applied to all or only a portion of the first surface or second surface or applied as an overcoat over all or a portion of the heat sensitive composition.

A microwave emitter such as a microwave oven can be employed for colorizing the heat sensitive composition layer or layers in proximity to the energy receiver material by heating the energy receiver material by microwave absorption so as to obscure information imaged in the heat sensitive composition.

In yet another embodiment, a method for obscuring confidential information is disclosed and comprises the steps of providing a substrate having first and second surfaces; providing on the first surface one or more layers of a heat sensitive composition comprising a chromogenic material and an electron accepting developer material; providing on all or a portion of the second surface a layer of an energy receiver material, recording information on to the first surface; and colorizing the heat sensitive composition layer or layers in proximity to the energy receiver material by heating the energy receiver material by microwave absorption so as to obscure the information recorded on the surface. Information can be recorded onto the first surface by conventional printing or by selectively thermally imaging the heat sensitive composition so as to record the information therein.

In yet another embodiment, the invention is a method for obscuring confidential information comprising providing a substrate having first and second surfaces; providing on the first surface one or more layers of a heat sensitive composition comprising a chromogenic material and an electron accepting developer material; providing on all or a portion of the second surface a layer of an energy receiver material in proximity to the heat sensitive composition; applying the substrate as a label onto a pharmaceutical container; recording information onto the first surface; and colorizing the heat sensitive composition layer or layers in proximity to the energy receiver material by microwave absorption so as to obscure information recorded on the first surface. Information can be recorded onto the first surface by conventional printing or by selectively thermally imaging the heat sensitive composition so as to record the information therein.

In one embodiment of the thermally-responsive record material, the material susceptible to inductive heating can be coated only over or under a portion of the heat sensitive color-forming composition provided on the substrate or applied as a back coating to a portion of the substrate. Alternatively, the heat sensitive color-forming composition is coated only over a portion of the substrate surface. In yet another embodiment the energy receiver material and the heat sensitive color-forming composition are both coated only over a portion of the substrate surface. Variations of such full or partial covering of the substrate with one or both coatings will be readily evident to the skilled artisan, as well as the use of optional intervening layers such as protectant layers, binders, antioxidant layers, UV absorbing layers and the like.

DETAILED DESCRIPTION

The present invention teaches thermally responsive record material comprising a substrate having provided thereon a heat sensitive color forming composition comprising: a chromogenic material and an electron accepting developer material, and, at least one layer of a material susceptible to inductive heating.

By "induction" or "inductive heating", it is meant that the energy receiver material absorbs energy such as microwave, infrared, radio frequency, or magnetic, and the term is intended liberally to encompass electromagnetic induction, RF (radio frequency), microwave, infrared and dielectric heating. Inductive heating for purposes hereof differs from conventional heating primarily in that no open flame is used, fumes are minimized and the inductive heating devices generally can be designed with cool-to-the-touch exteriors as is commonly observed for example with microwave ovens.

The material susceptible to inductive heating is an energy receiver material and preferably comprises a microwave susceptor meaning a microwave absorber, RF absorber, or dielectric material. A microwave susceptor is more preferred. The energy receiver material or microwave susceptor can take the form of a metallized film, metal coatings, various particles including metal particles, silicon carbide, carbon fibers, metal oxides, ferrite particles, metal fibers, metallic flakes, nonconductive composites of energy dissipative materials or particles dispersed in a dielectric binder, by way of illustration and not limitation. Materials such as bronze powders, graphite, and aluminum flake, were used in the examples herein producing substrates that heated rapidly and obscured sensitive information when placed in a conventional microwave oven for about 30 seconds.

By "particle," "particles," "particulate," "particulates," "powder," "fibers," "flakes" and the like, it is meant that a material is generally in the form of discrete units. The particles can include granules, pulverulents, powders, spheres or flakes. Thus, the particles can have any desired shape such as, for example, cubic, rod-like, polyhedral, spherical or semi-spherical, rounded or semi-rounded, angular, irregular, flat or plate-like, etc. Shapes having a large greatest dimension/smallest dimension ratio, like needles, flakes and fibers, are also contemplated for use herein. The use of "particle" or "particulate" may also describe an agglomeration including more than one particle, particulate, or the like.

The term "surface" and its plural generally refer herein to the outer or the topmost boundary of an object, unless the context indicates otherwise.

As used herein, the terms "in proximity to" or "in intimate association" and other similar terms are intended to encompass configurations including the following: those where at least a portion of the material susceptible to inductive heating or energy receiver material is in contact with or proximate to or under or over a portion of the heat sensitive layer; and/or those where at least a portion of an energy receiver material is in contact with a portion of another energy receiver material such as in, for example, a layered or mixed configuration, over or under the heat sensitive layer (including over or under intervening intermediate layers) or as an underside coating of the substrate, such as paper substrate.

A suitable energy receiver material absorbs energy at the desired frequency (typically between about 0.01 to about 300 GHz) very rapidly, in the range of fractions of a second or a few seconds. In practice, the substrate coated with the energy receiver material was found to heat the overall substrate to a temperature approaching 150° C. to 235° C. sufficient to darken the heat sensitive composition after about 30 seconds in a microwave oven. Shorter or longer times would be expected depending on the loading in the microwave oven, amount of absorber and the like.

A suitable energy receiver material should have a dielectric constant that is relatively high. The dielectric constant is a measure of how receptive to high frequency energy such as microwave energy a material is. These values apparently can be measured directly using instruments such as a Network Analyzer with a low power external electric field (i.e., 0 dBm to about +5 dBm) typically over a frequency range of about 300 kHz to about 3 GHz, although Network Analyzers to 20 GHz are readily available. For example, a suitable measuring system can include an HP8720D Dielectric Probe and a model HP8714C Network Analyzer, both available from Agilent Technologies (Brookfield, Wis., U.S.A.). Substantially equivalent devices may also be employed. Energy receiver materials useful in the present invention typically have a dielectric constant—measured in the frequency range of about 900 to about 3,000 MHz—of at least about 4; alternatively, at least 4; alternatively, at least about 8; alternatively, at least 8; alternatively, at least about 15; or alternatively, at least 15.

Examples of materials that may be suitable energy receiver materials or materials susceptible to inductive heating for purposes hereof, have been reported as having the noted dielectric constants: titanium dioxide (110), titanium oxide (40-50), sugar, sorbitol, ferrous sulfate (14.2), ferrous oxide (14.2), calcium superphosphate (14-15), zircon (12), graphite, high density carbon black (1215), calcium oxide granules (11.8), barium sulfate (11.4), ruby (11.3), silver chloride (11.2), silicon (11-12), magnesium oxide (9.7), alumina (9.3-11.5), anhydrous sodium carbonate (8.4), calcite (8), mica (7), dolomite (6.8-8). Other examples include, but are not limited to, various mixed valent oxides such as magnetite ($Fe_3O_4$), nickel oxide (NiO) and such; ferrite, tin oxide, zinc oxide, carbon, carbon black and graphite; sulfide semiconductors such as $FeS_2$, $CuFeS_2$; silicon carbide; various metal powders, particulates or fibers, such as aluminum, copper, bronze, iron and the like; various hydrated salts and other salts, such as calcium chloride dihydrate; polybutylene succinate and poly(butylene succinate-co-adipate), polymers and co-polymers of polylactic acid, various hygroscopic or water absorbing materials or more generally polymers or copolymers or non-polymers with many sites with —OH groups; other inorganic microwave absorbers including metals, aluminum hydroxide, zinc oxide, varium titanate and other organic absorbers such as polymers containing ester, aldehyde, ketone, isocyanate, phenol, nitrile, carboxyl, vinylidene chloride, ethylene oxide, methylene oxide, epoxy, amine groups, polypyrroles, polyanilines, polyalkylthiophenes, and mixtures thereof.

It should be further noted that the present invention is not limited to the use of only one material susceptible to inductive heating, but could also include mixtures of two or more such energy receiver materials. As previously indicated, the energy receiver material may be in particulate form; consequently, it is understood that the particles of energy receiver material may include solid particles, porous particles, or may be an agglomeration of more than one particle of energy receiver material. One skilled in the art would readily appreciate the possibility of treating the surface of a particle of energy receptive additive to enhance its ability to efficiently absorb microwave energy. Suitable surface treatments include scoring, etching, and the like. The energy receipt additive may also be in the form of an absorbed liquid or semi-liquid. In particular, a solution, dispersion or emulsion of one or more effective energy receptive additives may be formulated. When so deposited, at least a portion of the energy receptive additive would come into intimate association with or proximity to the heat sensitive composition.

In various embodiments of the present invention, the intimate association of an energy receiver material may be achieved with the optional use of a binder material. The binder material can include substances that can be applied in liquid or semi-liquid form to the energy receptive additive. The term "applied" as used herein is intended to include situations where: at least a portion of the surface of a particle of material susceptible to inductive heating has an effective amount of binder material on it or containing it to facilitate adherence, via mechanical and/or chemical bonding of at least a portion of the surface of the record material or heat sensitive layer to at least a portion of the material susceptible to inductive heating. In yet a further embodiment, the energy receiver material may be blended into the pulp mill furnish to disperse the energy receiver as an integral part of the manufactured paper substrate. In another embodiment the energy receiver material may be dispersed in any polymer and hot extruded into a film, co-extruded as a separate layer in a multi-layer co-extrusion or coated to the surface of a substrate as part of a multi-layer laminate. In yet another embodiment the energy receiver material can be sputter coated, spray coated, or electrodeposited onto the substrate or as a back coat to the substrate. Any commonly used technique to metalize or apply foils can also be advantageously used.

The energy receiver material can be dispersed in a binder material or dispersant such as a polymeric acrylate or polyvinyl alcohol to form a coating. The coating can be applied onto a surface of the substrate forming a subcoat or backcoat as desired. An optional surfactant can aid dispersion helping to form a coating slurry.

The selection of a particular binder material can be made by one skilled in the art and will typically depend upon the chemical composition of the materials to be maintained in intimate association with one another. The binder material is typically prepared by the formation of a liquid or semi-liquid or slurry. In particular, a solution, dispersion or emulsion including at least one of the various, preferably polymeric binder materials identified herein may be prepared. It may be applied to the selected material by any method such as by spraying in liquid or semi-liquid form, rod coating, curtain coating, blade coating, air knife coating and the like.

Alternatively, the energy receiver material particles can be dispersed into the substrate, such as into the furnish when a paper substrate is being formed such as using a Fourdinier paper machine. Similar dispersion into a film substrate during extrusion, for example, can be accomplished.

Looking now at the drawings FIG. 1 illustrates a general type of construction. FIG. 1 is a side view cross section of a thermally responsive record material according to the invention. Basestock paper 2 is shown having heat sensitive layer 1 coated onto the top surface. Energy receiver material layer 3 is coated or laminated onto the underside of basestock paper 2.

Figure 2:
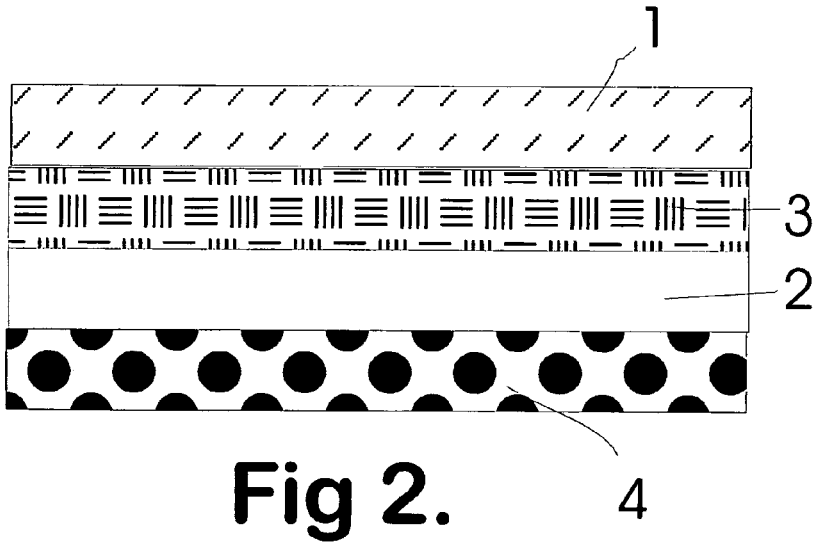
FIG. 2 is an alternate embodiment where the energy receiver material is a subcoat under the heat sensitive layer but on the top surface of the sheet of paper.
Figure 3:
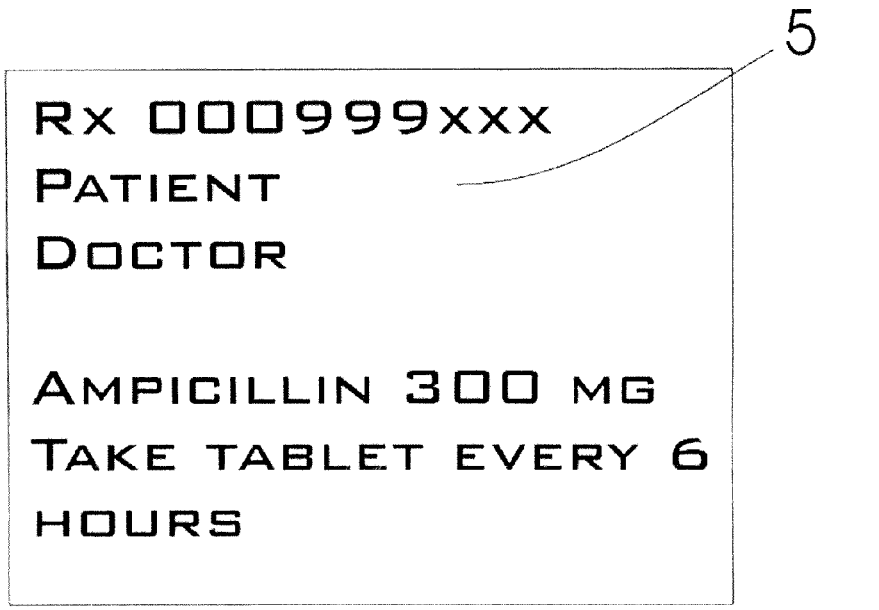
FIG. 3 is a top view of an alternative embodiment shown as a substrate constituting a pharmaceutical prescription label for typically applying to a pharmaceutical container containing an energy receiver material (not shown) covering only a portion of the sheet depicted as patient information field 5 obscured after inductive heating yielding obscured patient information field 5*a*.
Figure 3:
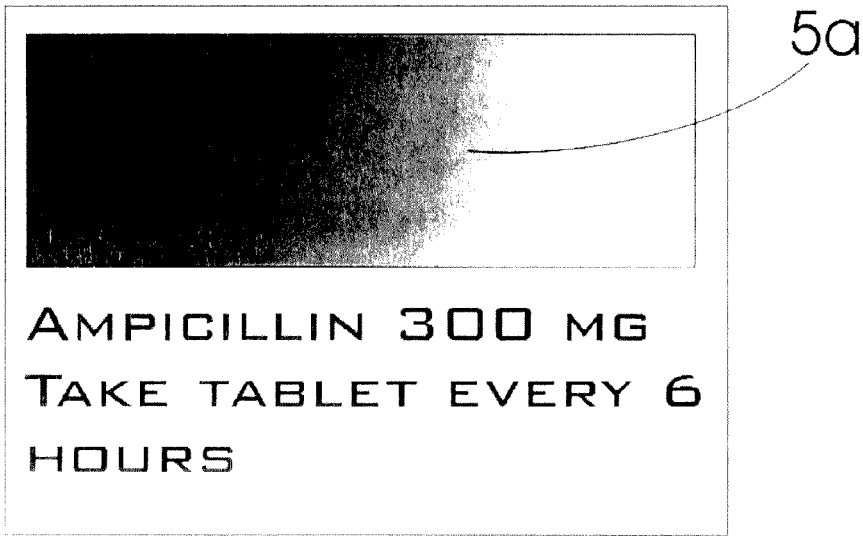

FIG. 2 illustrates an alternative embodiment where basestock paper 2 is coated or laminated on the top surface with energy receiver material layer 3. A heat sensitive layer 1 is overcoated over energy receiver material layer 3.

A pressure sensitive adhesive layer 4 is shown in FIGS. 1 and 2 as a bottom layer of the laminate or coated construction.

The general type of construction of the laminate layers or coating layers depicted in FIGS. 1 and 2 of a record material according to the invention can take the form a variety of architectures, as further illustrated in the ordering of the respective layers of a laminate described in Variations 1 to 4 below.

| | |
|---|---|
| Variation 1 | Heat sensitive (imaging) layer |
| | Basestock paper |
| | Adhesive |
| | Metallized film |
| | Pressure sensitive adhesive layer |
| Variation 2 | Heat sensitive (imaging) layer |
| | Subcoat |
| | Metallized basestock |
| | Pressure sensitive adhesive layer |
| Variation 3 | Heat sensitive (imaging) layer |
| | Subcoat with metallic particles |
| | Basestock paper |
| | Pressure sensitive adhesive layer |
| Variation 4 | Top coat |
| | Heat sensitive (imaging) layer |
| | Subcoat |
| | Basestock paper |
| | Metallized undercoat |
| | Pressure sensitive adhesive layer |

In Variation 1 the heat sensitive layer is to the top surface of a sheet or web of basestock paper. A metallized film for example can be adhesively laminated or melt extruded to an underside of the basestock paper. The metallized film would function as the energy receiver material in this variation. A pressure sensitive adhesive is coated onto the underside of the metallized film.

In Variation 2 the heat sensitive layer is applied over a subcoat such as a clay or energy reflecting layer such as insulated foam or microbeads or hollow sphere materials. Under the subcoat layer is a metallized basestock serving as the energy receiver material. This can take the form of metallic powders or particles distributed through the basestock paper as part of the paper furnish during paper manufacture or as a coating over or under the paper applied subsequent to basestock paper manufacture.

In Variation 3 a heat sensitive layer is coated onto a subcoat that contains energy receiver material such as metallic particles. The subcoat is coated or adhered onto the top surface of the basestock paper. A pressure sensitive adhesive is indicated as the bottom surface of this construction.

In Variation 4 a protective top coat such as a UV layer or polymeric material such as polyvinyl alcohol or polyacrylate is provided as the top layer over the heat sensitive layer. The heat sensitive layer is coated over a subcoat such as clay or heat insulating material to facilitate imaging of the heat sensitive layer. To the bottom surface of the basestock paper there is coated, adhered or melt extruded an energy receptive material such as a metallized undercoat or metallic particulate dispersed in a binder material.

The heat sensitive layer or thermally responsive record material comprises a support having provided thereon in substantially contiguous relationship an electron donating dye precursor (chromogenic material), an acidic developer material, and optionally a sensitizer and binder therefor.

The record material according to the invention has a non-reversible image in that it is substantially non-reversible under the action of heat. The coating of the record material of the invention is basically a dewatered solid at ambient temperature.

The color-forming system of the record material of this invention includes chromogenic material (electron-donating dye precursor) in its substantially colorless or light-colored state and acidic developer material. The color-forming system relies upon melting, softening, or subliming one or more of the components to achieve reactive, color-producing contact with the chromogen.

The record material includes a substrate or support material which is generally in sheet form. For purposes of this invention, sheets can be referred to as support members and are understood to also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper or plastic such as filamentous synthetic materials. It can be a plastic such as film including, for example, cellophane and synthetic polymeric sheets cast, extruded, or otherwise formed. The invention primarily resides in the compositions coated on or under the substrate. In certain embodiments, the energy receiver material is applied as a back coat to all or a portion of the underside of the substrate. In alternative embodiments the energy receiver material is dispersed within the substrate such as within the paper furnish during paper manufacture. The type of substrate is a matter of selection and preference without limitation.

The components of the color-forming system are in substantially contiguous relationship, substantially homogeneously distributed throughout the coated layer material deposited on the substrate. The term substantially contiguous is understood to mean that the color-forming components are positioned in sufficient proximity such that upon melting, softening or subliming one or more of the components, a reactive color forming contact between the components is achieved. As is readily apparent to the person of ordinary skill in this art, these reactive components accordingly can be in the same coated layer or layers, or isolated or positioned in separate but adjacent layers. In other words, one component can be positioned in the first layer, and reactive or sensitizer components positioned in a subsequent layer or layers. All such arrangements are understood herein as being substantially contiguous.

In manufacturing the record material, a coating composition is prepared which includes a fine dispersion of the components of the color-forming system, binder material preferably polymeric binder such as polyvinyl alcohol or acrylic latex, surface active agents and other additives in an aqueous coating medium. Surfactants for the color forming system or dispersing the energy receiver material can include any of various surface active materials, and without limitation include sodium dodecylsulfate, sodium dodecylbenzene sulfate, cetyl trimethyl ammonium bromide, acetylenic glycol and the like. The composition can additionally contain inert pigments, such as clay, talc, silicone dioxide, aluminum hydroxide, calcined kaolin clay and calcium carbonate; synthetic pigments, such as urea-formaldehyde resin pigments; natural waxes such as Carnauba wax; synthetic waxes; lubricants such as zinc stearate; wetting agents; defoamers, sensitizers and antioxidants and p-benzylbiphenyl. Modifiers or sensitizers can also be included in the heat sensitive layer or composition. Sensitizers for example can include acetoacet-o-toluidine, phenyl-1-hydroxy-2-nophthoate, 1,2-diphenonxyethane, p-benzylbiphenyl, benzyl acetate, benzyloxyphenyl ethers (U.S. Pat. Nos. 6,566,301; 6,599,097; and 6,429,341). The sensitizer typically does not impact any image on its own but as a relatively low melt point solid acts as a solvent to facilitate reaction between the mark forming components of the color-forming system.

The color-forming system components are substantially insoluble in the dispersion vehicle (preferably water) and are ground to an individual average particle size of between about 1 micron to about 10 microns, preferably about 1-3 microns or less. The polymeric binder material is substantially vehicle soluble or a latex dispersion. Preferred water soluble binders include polyvinyl alcohol, hydroxy ethylcellulose, methylcellulose, methyl-hydroxypropylcellulose, starch, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection in an amount less than will interfere with achieving reactive contact between color-forming reactive materials.

Coating weights can effectively be about 2 to about 9 grams per square meter (gsm) and preferably about 5 to about 6 gsm. Coat weight of the energy receiver material can be considerably less, as little as 0.05 grams per square meter in some applications. The practical amount of color-forming materials or energy receiver materials is controlled by economic considerations, functional parameters and desired handling characteristics of the coated sheets.

Eligible electron donating dye precursors are chromogenic materials, such as the phthalide, leucauramine and fluoran compounds, for use in the color-forming system. Various chromogenic materials for use in color-forming systems are well known color-forming compounds or dye precursors. Examples of the compounds include Crystal Violet Lactone (3,3-bis(4-dimethylaminophenyl)-6-dimethylaminophthalide, U.S. Pat. No. RE. 23,024); phenylincol-, pyrrol-, and carbazol-substituted phthalides (for example in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787, 3,641,011; 3,642,828; 3,681,390); spiro-dipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention to any way, are: 3-diethylamino-6-methyl-7-anilino-fluoran (U.S. Pat. No. 3,681,390); 2-anilino-3-methyl-6-dibutylamino-fluoran (U.S. Pat. No. 4,510,513) also known as 3-dibutylamino-6-methyl-7-anilino-fluoran; 3-dibutylamino-7-(2-chloroanilino)fluoran; 3-(N-ethyl-N-tetrahydrofurfurylamino)-6-methyl-7-3,5,6-tris(dime-thylamino) spiro ›9H-fluorene-9,1', (3'H)-isobenzofuran!-3'-one; 7-(1-ethyl-2-methylindol-3-yl)-7-(4-diethylamino-2-ethoxyphenyl)-5,7-dihydrofuro›3,4-b!pyridin-5-one (U.S. Pat. No. 4,246,318); 3-diethylamino-7-(2-chloroanilino) fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro›3,4-b!pyridin-5-one; 3-diethylamino-7,8-benzofluoran; 3,3-bis(1-ethyl-2-methylindo 1-3-yl)phthalide; 3-diethylamino-7-anilinofluoran; 3-diethylamino-7-benzylaminofluoran; 3,-phenyl-7-dibenzylamino-2,2'-spiro-di-›2H-1-benzopyran! and mixtures of any of the following.

Examples of eligible acidic developer material include the compounds listed in U.S. Pat. No. 3,539,375 as phenolic reactive material, particularly the monophenols and diphenols. Other eligible acidic developer material which can be used also include, without being considered as limiting, the following compounds:

4,4'-isopropylidinediphenol(Bisphenol A); p-hydroxybenzaldehyde; p-hydroxybenzophenone; p-hydroxypropiophenone; 2,4-dihydroxybenzophenone; 1,1-bis(4-hydroxyphenyl)cyclohexane; salicyanilide; 4-hydroxy-2-methylacetophenone; 2-acetylbenzoic acid; m-hydroxyacetanilide; p-hydroxyacetanilide; 2,4-dihydroxyacetophenone; 4-hydroxy-4,-methylbenzophenone; 4,4'-dihydroxybenzophenone; 2,2-bis(4-hydroxyphenyl)-4-methylpentane; benzyl 4-hydroxyphenyl ketone; 2,2-bis(4-hydroxyphenyl)-5-methylhexane; ethyl-4,4-bis(4-hydroxyphenyl)-pentanoate; isopropyl-4,4-bis(4-hydroxyphenyl) pentanoate; methyl-4,4-bis(4-hydroxyphenyl)pentanoate; alkyl-4,4-bis(4-hydroxyphenyl)pentanoate; 3,3-bis(4-hydroxyphenyl-pentane; 4,4-bis(4-hydroxyphenyl pentanoate; 3,3-bis(4-hydroxyphenyl)-pentane; 4,4-bis(4-hydroxyphenyl)-heptane; 2,2-bis(4-hydroxy-phenyl) butane; 2,2,-methylene-bis(4-ethyl-6-tertiarybutyl phenol); 4-hydroxy-coumarin; 7-hydroxy-4-methylcoumarin; 2,2,-methylene-bis(4-octylphenol); 4,4,-sulfonyldiphenol; 4,4'-thiobis(6-tertiarybutyl-m-cresol); methyl-p-hydroxybenzoate; n-propyl-p-hydroxybenzoate; benzyl-p-hydroxybenzoate. Preferred among these are the phenolic developer compounds. More preferred among the phenol compounds are 4,4,-isopropylindinediphenol, ethyl-4,4-bis(4-hydroxyphenyl)-pentanoate, n-propyl-4,4-bis(4-hydroxyphenyl)pentanoate, isopropyl-4,4-bis(4-hydroxyphenyl)pentanoate, -methyl-4,4-bis(4-hydroxyphenyl)pentanoate, 2,2-bis(4-hydroxy-phenyl)-4-4-methylpentane, p-hydroxybenzophenone, 2,4-dihydroxybenzophenone, 1,1-bis(4-hydroxyphenyl)cyclohexane, and benzyl-p-hydroxybenzoate. Acid compounds of other kind and types are eligible.

Examples of other eligible acidic developer compounds for use with the invention are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen.

Coating can be applied by any conventional means such as air knife, blade, rod, flexo, slot die, slot fed curtain, multi-layer slot die, multi-layer slot die fed curtain, slide die, slide die fed curtain, multi-layer slide die fed curtain and the like.

The following examples are given to illustrate some of the features of the present invention and should not be considered as limiting. Unless otherwise indicated, all measurements, parts and proportions herein are in the metric system and on the basis of weight.

All patents and publications cited herein are hereby fully incorporated by reference in their entirety. The citation of any publication is for its disclosure prior to the filing date and should not be construed as an admission that such publication is prior art or that the present invention is not entitled to antedate such publication by virtue of prior invention.

The principles, preferred embodiments, and modes of operation of the present invention have been described in the foregoing specification. The invention which is intended to be protected herein, however, are not to be construed as limited to the particular forms disclosed, since those are to be regarded as illustrative rather than restrictive. Variations and changes can be made by those skilled in the art without departing from the spirit and scope of the invention.

EXAMPLES

Samples were prepared and imaged in a conventional microwave oven (Sharp R-230H, 1200 watt). The Sharp microwave has a "minute plus" quick heat option. Desirably, the heating and darkening of the label occurs in minutes and more preferably in seconds. With the following examples, darkening was generally observed and the image obscured at about 30 seconds.

The microwave susceptor material should be capable of being heated up to a temperature of about 232° C. and more preferably in a temperature range of about 150° C. to 225° C.

Formula 1

13 parts acrylic binder a polymer at 50% solids
0.2 parts surfactant (Acetylenic glycol, Surfynol™ 440, Air Products, Allentown, Pa.)
4.5 parts bronze powder, 98% sized less than 74 microns
0-10 parts water to achieve coat weight Formula 2

18 parts acrylic binder polymer at 50% solids
0.2 parts surfactant (acetylenic glycol)
3 parts bronze powder, 98% sized less than 74 microns
2 parts aluminum flake, particle size 8-18 microns
0-10 parts water to achieve coat weight Formula 3

5 parts acrylic binder polymer at 31.5% solids
0.2 parts surfactant (acetylenic glycol)
3 parts graphite powder, particle size 1-2 micron
7-15 parts water to achieve coat weight Formula 4

10 parts acrylic binder polymer at 31.5% solids
0.2 parts surfactant (acetylenic glycol)

3 parts graphite powder, particle size 1.2 micron
7-15 parts water added to achieve coat weight Formula 5
10 parts acrylic binder polymer at 31.5% solids
0.2 parts surfactant (acetylenic glycol)
3 parts graphite powder, particle size 1.2 micron
3 parts magnesium iodate tetrahydrate
7-15 parts water added to achieve coat weight Formula 6—Thermal Basecoat
45 parts styrene butadiene rubber latex at 50% solids
1 parts surfactant (acetylenic glycol)
70 parts calcined clay
70-100 parts water to achieve coat weight and wet out clay Formula 7—Thermal Active Coat
10 parts styrene butadiene rubber latex at 50% solids
60 parts 4-hydroxyphenyl-4'-isopropoxyphenyl sulfone at 50% solids
5 parts polyvinyl alcohol at 20% solids
70 parts dimethyl terephthalate at 50% solids
45 parts 3-di-n-butylamino)-6-methyl-7-anilino fluoran, at 38% solids
6-10 parts water to achieve coat weight Formula 8—Thermal Topcoat
100 parts carboxylated polyvinyl alcohol at 15% solids
0.4 parts surfactant (acetylenic glycol)
50 parts pigment dispersion at 50% solids
5 parts zinc stearate dispersion at 44% solids
35 parts cross-linking agent at 12.5% solids
5-10 parts water to achieve coat weight Example 1

Layer 1—Formula 8—thermal topcoat @ 2.0 lbs/ream (0.9 kg/ream)
Layer 2—Formula 7—thermal activecoat @ 2.5 lbs/ream (1.1 kg/ream)
Layer 3—Formula 6—thermal basecoat @ 5.0 lbs/ream (2.2 kg/ream)
Layer 4—paper substrate
Layer 5—Formula 1—microwave susceptor @ 6 lbs/ream (2.7 kg/ream)

Example 2

Layer 1—Formula 8—thermal topcoat @ 2.0 lbs/ream (0.9 kg/ream)
Layer 2—Formula 7—thermal activecoat @ 2.5 lbs/ream (1.10 kg/ream)
Layer 3—Formula 6—thermal basecoat @ 5.0 lbs/ream (2.2 kg/ream)
Layer 4—paper substrate
Layer 5—Formula 2—microwave susceptor @ 6 lbs/ream (4.08 kg/ream)

Example 3

Layer 1—Formula 8—thermal topcoat @ 2.0 lbs/ream (0.9 kg/ream)
Layer 2—Formula 7—thermal activecoat @ 2.5 lbs/ream (1.1 kg/ream)
Layer 3—Formula 6—thermal basecoat @ 5.0 lbs/ream (2.2 kg/ream)
Layer 4—Formula 3—microwave susceptor @ 2 lbs/ream (0.9 kg/ream)
Layer 5—paper substrate Example 4

Layer 1—Formula 8—thermal topcoat @ 2.0 lbs/ream (0.9 kg/ream)
Layer 2—Formula 7—thermal activecoat @ 2.5 lbs/ream (1.1 kg/ream)
Layer 3—Formula 6—thermal basecoat @ 5.0 lbs/ream (2.2 kg/ream)
Layer 4—Formula 4—microwave susceptor @ 3.5 lbs/ream (1.6 kg/ream)
Layer 5—paper substrate Example 5

Layer 1—Formula 8—thermal topcoat @ 2.0 lbs/ream (0.9 kg/ream)
Layer 2—Formula 7—thermal activecoat @ 2.5 lbs/ream (1.1 kg/ream)
Layer 3—Formula 6—thermal basecoat @ 5.0 lbs/ream (2.2 kg/ream)
Layer 4—Formula 5—microwave susceptor @ 6 lbs/ream (2.7 kg/ream)
Layer 5—paper substrate Example 5 contained magnesium iodate tetrahydrate (dehydrates at 210° C. as a temperature controlling function).

All samples were tested on Sharp Carousel microwave oven (1200 Watt, 2450 MHz) using the minute plus button.

Reams were 3300 sq. ft. (306.58 sq. meters), 500 sheets, 8.5×11 inches (21.59 cm×27.94 cm).

What is claimed is:

1. A method for obscuring confidential information comprising:

providing a substrate having first and second surfaces;

providing on the first surface one or more layers of a heat sensitive composition comprising a chromogenic material and an electron accepting developer material; providing on all or a portion of the second surface a layer of an energy receiver material; recording information onto the first surface by selectively thermally imaging the heat sensitive composition so as to record the information; and, colorizing the heat sensitive composition layer or layers in proximity to the energy receiver material by heating the energy receiver material by microwave absorption so as to obscure information recorded on the first surface.

2. A method for obscuring confidential information comprising:

providing a substrate having first and second surfaces;

providing on the first surface one or more layers of heat sensitive composition comprising a chromogenic material and an electron accepting developer material;

providing on all or a portion of the second surface a layer of an energy receiver material in proximity to the heat sensitive composition, applying the substrate as a label onto a pharmaceutical container;

recording information onto the first surface by selectively thermally imaging the heat sensitive composition so as to record information thereon;

colorizing the heat sensitive composition layer or layers in proximity to the energy receiver material by heating the energy receiver material by microwave absorption so as to obscure information recorded on the first surface.

* * * * *